US005820479A

United States Patent [19]

Cline et al.

[11] Patent Number: 5,820,479

[45] Date of Patent: Oct. 13, 1998

[54] GOLF CLUB HOLDER

[76] Inventors: Bobby G. Cline, 2727 W. Bella Vista St., Lakeland, Fla. 33809-8713; Allen R. Jennings, 1221 Durham Dr., Lakeland, Fla. 33809-2312

[21] Appl. No.: 838,061

[22] Filed: Apr. 17, 1997

[51] Int. Cl.[6] ..... A63B 55/04; A63B 55/10

[52] U.S. Cl. ..... 473/282; 211/70.2; 248/156

[58] Field of Search ..... 473/282; 211/70.2; 248/154, 156

[56] References Cited

U.S. PATENT DOCUMENTS

| | | | |
|---|---|---|---|
| 699,391 | 5/1902 | Johnson . | |
| 2,887,137 | 5/1959 | Robb | 150/1.5 |
| 4,616,749 | 10/1986 | Briggs | 206/315.2 |
| 4,991,839 | 2/1991 | Lumbattis, Jr. . | |
| 5,080,239 | 1/1992 | Rowland | 211/70.2 |
| 5,127,530 | 7/1992 | Ortuno | 211/70.2 |
| 5,149,087 | 9/1992 | Thompson, Jr. . | |
| 5,230,507 | 7/1993 | White | 473/282 |
| 5,285,990 | 2/1994 | Engel | 248/156 |
| 5,390,916 | 2/1995 | Govoni . | |
| 5,417,334 | 5/1995 | Wu | 211/70.2 |
| 5,485,931 | 1/1996 | Barr | 211/70.6 |
| 5,492,230 | 2/1996 | Horton | 473/282 |
| 5,597,363 | 1/1997 | Leote | 473/282 |

*Primary Examiner*—Sebastiano Passaniti
*Assistant Examiner*—Stephen L. Blau
*Attorney, Agent, or Firm*—Pettis & Van Royen, P.A.

[57] ABSTRACT

A golf club holder defined by an elongate rod, the distal end of which is insertable into a support surface. A club shaft receiver block is attached to the rod's proximal end, and that block includes at least one aperture formed therethrough in substantially parallel relation to the longitudinal axis of the rod. A slot communicates through the side of the block with the aperture such that a golf club shaft may be passed through the slot, and the exterior of the club shaft will engage the interior of the aperture to hold the club therein with the club head above the support surface. In alternate embodiments of the invention, the receiver block may include more than one aperture/slot combination so that the holder may retain a corresponding number of golf clubs.

7 Claims, 3 Drawing Sheets

GOLF CLUB HOLDER

BACKGROUND OF THE INVENTION

1. Field of the Invention

The present invention relates to a golf club holder of the type primarily intended for supporting at least one golf club above a support surface.

2. Description of the Prior Art

One can hardly deny the extreme popularity of golf as both a professional and recreational sport throughout the United States and around the world. Particularly with regard to the recreational golfer, who rarely uses a professional caddie today, it is quite common to see the golfer carrying two or more clubs in his or her hands in the vicinity of the golf green. This is particularly true because golf cart paths rarely come close enough to golf greens so as to permit the golfer to select clubs conveniently from his or her golf bag.

In recognition of the fact that it is frequently necessary to take one additional club in addition to the putter when one approaches the green, a number of accessory-type devices are known in the prior art for holding one or more clubs while another is being used. One such device is disclosed in U. S. Pat. No. 5,149,087 to Thompson. That device comprises an elongate rod, the distal end of which may be inserted into the ground. A hook-type structure is provided in the vicinity of the handle of the rod so that one or more clubs may rest therein, and be supported thereby, with the head of a supported club also resting on the ground.

A similar device is disclosed in U. S. Pat. No. 5,080,239 to Roland. The holder of that patent also comprises an elongate rod, the distal end of which is inserted into the ground. Mounted substantially adjacent the handle of the rod are a series of ring-like members so that the handle of a golf club may be placed within the ring and the head of the club will rest on the ground, thereby supporting the club.

U. S. Pat. No. 5,597,363 to Leote discloses a similar device for supporting the shaft of a club while the head rests on the ground. The device of that patent also includes a holder for other golf accessories such as, for example, a golf ball or a towel.

U. S. Pat. No. 5,285,990 to Engel teaches a golf club rest for supporting the shaft of a club with the club head sitting on the ground. The device of U. S. Pat. No. 5,390,916 to Govoni teaches another such device wherein the supporting rod not only has a hook-type member extending from the top thereof, but also the rod comprises a hollow tube for receiving the shaft of a golf club. Thus, the device of this invention can hold one club, with the golf club head up, within the tube, and a second club shaft can be received and supported by the hook with that club's head resting on the ground.

U. S. Pat. No. 5,127,530 to Ortuno discloses a wire-type golf club stand, the top (proximal) end of which is deformed to provide a receptacle for the grip of one or more golf clubs. The head of the club rests on the ground.

U. S. Pat. No. 2,887,137 to Robb teaches the use of a disk element at the top of a support rod. The disk comprises a plurality of slots therethrough for receiving the handle portion of a golf club. The head of the club rests on the ground.

The inventions of U. S. Pat. No. 699,391 to Johnson and of U. S. Pat. No. 5,417,334 to Wu each disclose holders for golf clubs wherein the grip of the club is oriented downwardly, and the head of the club extends upwardly. Finally, U. S. Pat. No. 4,616,749 to Briggs and U. S. Pat. No. 4,991,839 each disclose golf club supports which hold one or more golf clubs in a generally prone position with the head of the club sitting on the ground and the grip of the club at least slightly elevated above the ground.

While each of the devices identified above is certainly acceptable for accomplishing its stated purpose, it is clear that there remains a need in the art for a simple golf club holder capable of receiving and holding at least one golf club in substantially vertical relation to the ground such that no portion of the club contacts the ground. Such a device must be of relatively simple construction, suitable for supporting virtually any known golf club above the ground, and must also be of a size and weight suitable for carrying in the golfer's golf bag.

SUMMARY OF THE INVENTION

The present invention relates to a golf club holder of the type primarily intended for supporting at least one golf club above a support surface. According to a first preferred embodiment, the golf club holder comprises an elongate rod having a proximal end and a distal end, the distal end being insertable into the support surface (the ground). A club shaft receiver block is attached to the rod's proximal end, and that receiver block comprises at least one aperture formed therein and extending from a top surface of the block to a bottom surface of the block such that the longitudinal axis of the aperture is substantially parallel to the longitudinal axis of the rod. A slot extends through a side of the block from its top surface to its bottom surface in intersecting relation to the aperture such that a golf club shaft may pass through the slot and be held within the aperture above the support surface so that the shaft of the golf club is substantially parallel to the longitudinal axis of the rod, with the head of the golf club oriented toward the ground but spaced thereabove. According to a second preferred embodiment, a plurality of apertures and corresponding slots are provided in the club shaft receiver block, so that the holder of this invention may receive and support a corresponding plurality of golf clubs.

The invention accordingly comprises an article of manufacture possessing the features, properties, and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
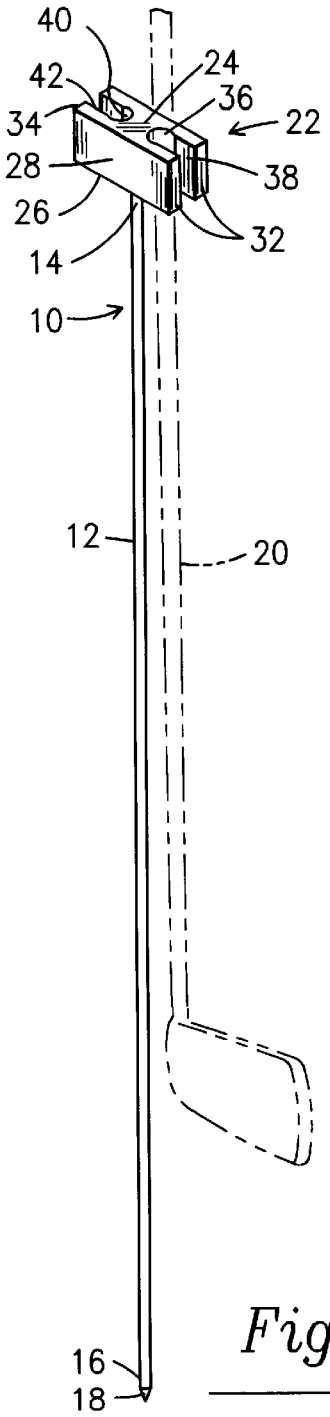
FIG. 1 is a perspective view of a two club embodiment of the holder of this invention showing a portion of a golf club held therein in phantom lines.
Figure 2:
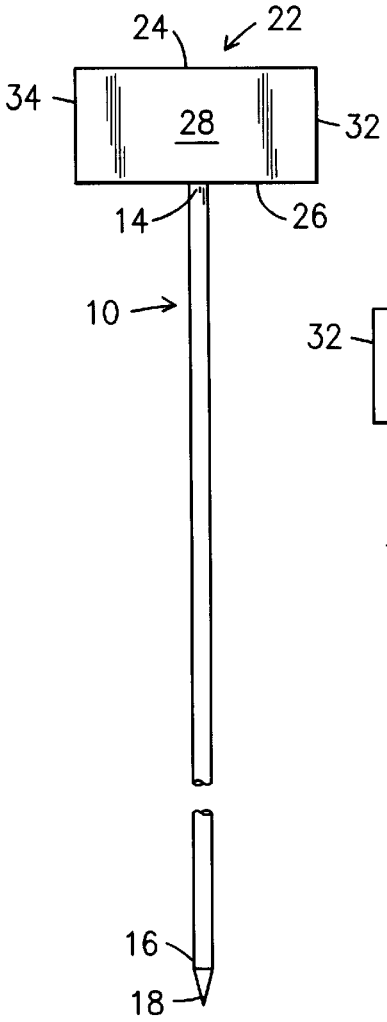
FIG. 2 is a left side elevation of the holder of FIG. 1.
Figure 3:
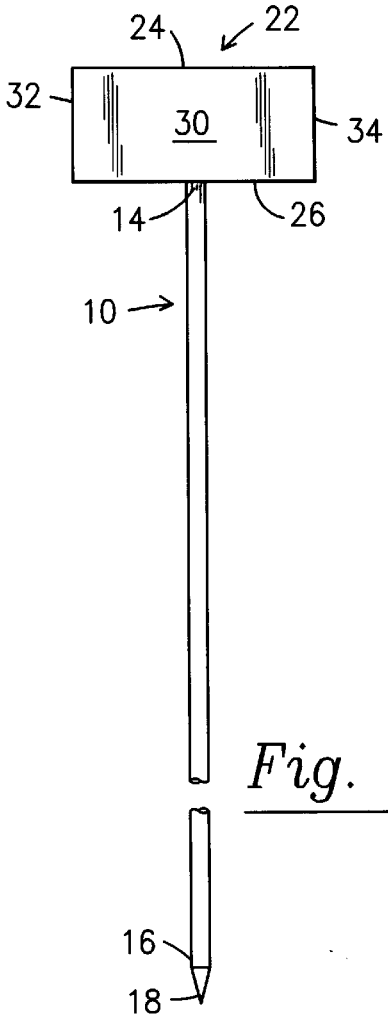
FIG. 3 is a right side elevation of the holder of FIG. 1.
Figure 4:
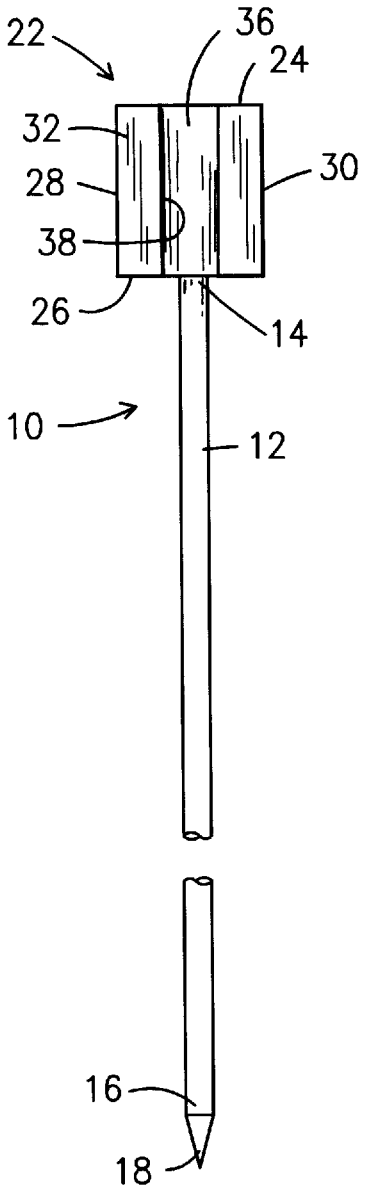
FIG. 4 is a front side elevation of the holder of FIG. 1.
Figure 5:
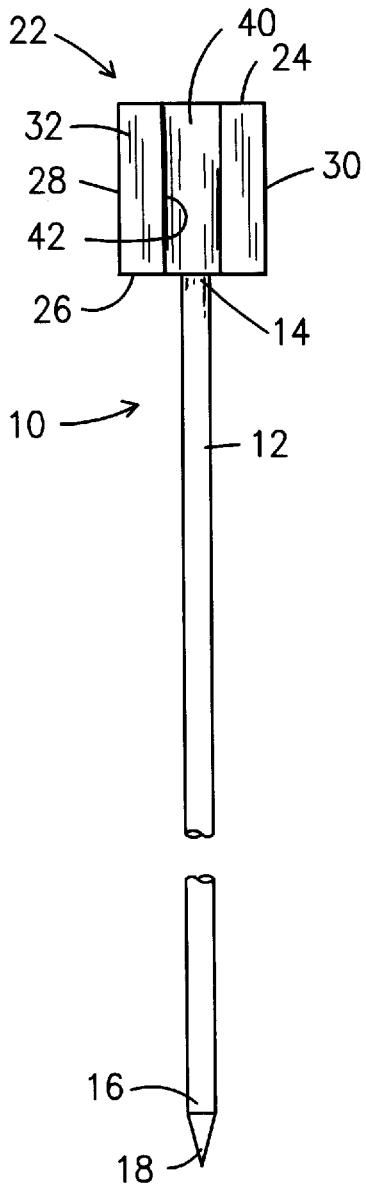
FIG. 5 is a back side elevation of the holder of FIG. 1.

A two-club version of the holder of this invention is illustrated in the view of FIG. 1, and is generally indicated as 10. Holder 10 comprises an elongate rod 12 having a proximal end 14 and a distal end 16. Distal end 16 preferably includes a pointed tip 18, whereby the holder 10 may be inserted into a support surface such as, for example, the ground (not shown). Club holder 10 may be used to support either one or two golf clubs, and a club 20 is shown in phantom in the view of FIG. 1.

In its preferred embodiment, rod 12 is preferably metal, though any suitably rigid material may be used. Fixed to proximal end 14 of rod 12 is a club shaft receiver block, generally indicated as 22. Attention is invited to the detailed view of FIG. 8 and to the top and bottom plan views of FIGS. 6 and 7 for construction details of receiver block 22.

In its preferred embodiments, receiver block 22 is preferably injection molded from a plastic material; however, the scope of the present invention is not to be limited to such material nor such a means of manufacture. Virtually any suitably rigid material may be used, and the construction details hereinafter described may be accomplished by means other than injection molding. It is also to be understood that receiver block 22 may be attached to proximal end 14 of rod 12 by any suitable means such as, for example, press fitting, gluing, or screwing. As seen the views of FIGS. 1 and 8, receiver block 22 is basically rectangular and has a top surface 24, a bottom surface 26, a left side 28, a right side 30, a front 32, and a back 34.

A first aperture 36 is formed through block 22 and extends from top surface 24 through bottom surface 26 such that the axis of first aperture 36 is substantially parallel to the axis of rod 12. A first slot 38 is formed through front 32 of receiver block 22 and communicates with first aperture 36. As clearly seen in the view of FIG. 8, the second aperture 40 with a corresponding second slot 42 is formed in receiver block 22 in opposed relation to first aperture 36 and first slot 38.

Figure 6:
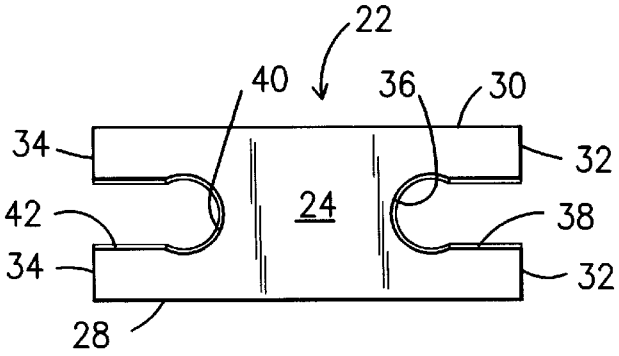
FIG. 6 is a top plan view of the holder of FIG. 1.
Figure 7:
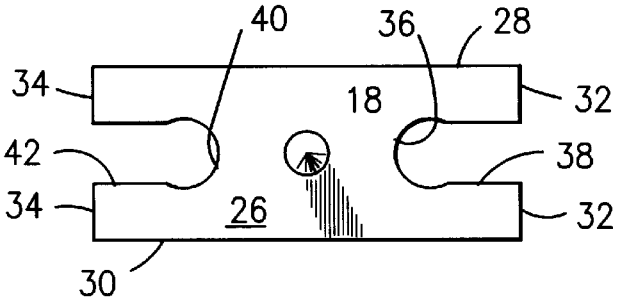
FIG. 7 is a bottom plan view of the holder of FIG. 1.
Figure 8:
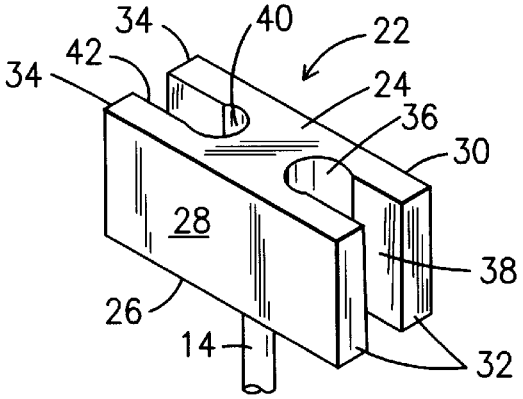
FIG. 8 is a detailed view of the shaft receiver block and a proximal segment of the elongate rod shown in FIG. 1.

Referring now to the views of FIGS. 6 and 7, it can be seen that the diameter of first aperture 36 and second aperture 40, adjacent top surface 24, are slightly greater than the corresponding diameters adjacent bottom surface 26. That is to say, in this preferred embodiment, the diameter of each of the apertures 36 and 40 is slightly tapered. This tapered construction provides for a relatively snug engagement of either aperture 36 or aperture 40 with the shaft of a club 20 placed therein. Of course, it is well known that the shafts of golf clubs 20 typically define a similar, tapered construction. Referring again to the views of FIGS. 6 and 7, it can be seen that the effective width of first slot 38 and second slot 42 are similarly tapered, with their respective widths being slightly greater adjacent top surface 24 that the corresponding width adjacent bottom surface 26. It can also be noted that the width of both first slot 38 and second slot 42 is less than the diameter of first aperture 36 and second aperture 40 adjacent top surface 24.

Figure 9:
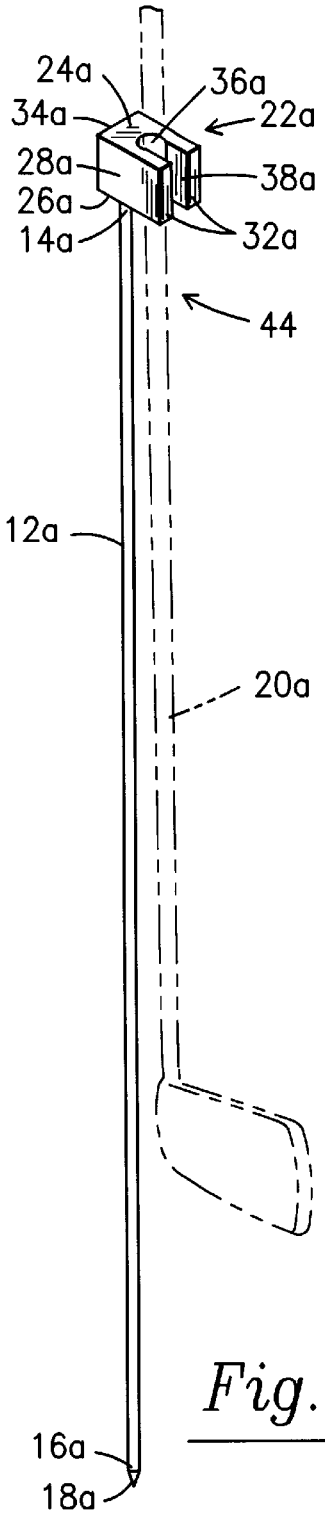
FIG. 9 is a perspective view similar to that of FIG. 1 showing a single club embodiment of the holder of this invention.

Referring to the view of FIG. 9, one sees a single club embodiment of the present invention which has been generally indicated as 44. Inasmuch as the structural elements of single club holder 44 are identical to those previously described and defined, they are identified by like reference numerals with the addition of a lower case letter "a." Of course, because the single club holder 44 receives just one club 20*a*, there is only a single first aperture 36*a* and its corresponding first slot 38*a*, and back 34*a* is solid.

By comparing the structure of single club holder 44 with that of two-club holder 10, one may readily appreciate that the scope of this invention is not to be limited to either a single or double club configuration. The number of clubs to be held is really limited only by the size of the receiver block selected. However, for purposes of stability, the corresponding aperture/slot structures should be equally spaced around the perimeter of the receiver block.

From the foregoing description of the two embodiments of the golf club holder 10 and 44, it is clear that the construction is uniquely capable of holding one or more golf clubs above the ground so that no portion of the club will become wet or dirty. When so held, clubs are more visible to the player and less likely to be forgotten when the player leaves the green. The size of holders 10 and 44 is such that the invention will easily fit into the golfer's bag so as to be ready for use when needed.

It will thus be seen that the objects set forth above, among those made apparent from the preceding description, are efficiently attained, and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A golf club holder of the type primarily intended for supporting at least one golf club above a support surface, said golf club holder comprising: an elongate rod having a proximal end and a distal end, said distal end being insertable into the support surface, and a rod axis being defined by a line connecting said rod proximal end and said rod distal end; a club shaft receiver block attached to said rod proximal end; said shaft receiver block being formed from a rigid material and comprising at least one aperture formed therein, said aperture extending from a top surface of said block to a bottom surface of said block to define an aperture axis therebetween, said aperture axis being substantially parallel to said rod axis, a diameter of said aperture at said top surface being greater than a corresponding diameter of said aperture at said bottom surface; and said shaft receiver block further comprising a slot extending through a side of said block from said top surface to said bottom surface, said slot intersecting said aperture in substantially normal relation to said aperture axis such that a golf club shaft may pass through said slot and be held within said aperture above the support surface in substantially parallel relation to said rod axis.

2. A golf club holder as in claim 1 wherein said aperture is substantially round.

3. A golf club holder as in claim 1 wherein said slot defines a width through said side of said block that is less than said diameter of said aperture at said top surface.

4. A golf club holder as in claim 3 wherein said width at said bottom surface is less than said diameter of said aperture at said bottom surface.

5. A golf club holder as in claim 1 further comprising a plurality of said apertures and a corresponding plurality of said slots.

6. A golf club holder as in claim 5 wherein each one of said apertures is equally spaced from another of said apertures.

7. A golf club holder as in claim 5 wherein each of said apertures is substantially round, and wherein each of said corresponding slots defines a width through said side of said block that is less than said diameter of said corresponding aperture at said top surface and said width at said bottom surface is less than said diameter of said corresponding aperture at said bottom surface.

* * * * *